United States Patent [19]

Thorn et al.

[11] 4,068,676

[45] Jan. 17, 1978

[54] METHOD FOR DISSOLVING POLYMERIC MATERIALS IN HYDROCARBON LIQUIDS

[75] Inventors: Donald J. Thorn; John W. Burnham, both of Duncan, Okla.

[73] Assignee: Halliburton Company, Duncan, Okla.

[21] Appl. No.: 652,356

[22] Filed: Jan. 26, 1976

[51] Int. Cl.[2] ..... F17D 1/16

[52] U.S. Cl. ..... 137/13; 166/308; 252/8.55 R; 252/363.5

[58] Field of Search ..... 252/8.55 R, 363.5; 260/33.6 UA, 34.2, 29.6 WQ; 166/308; 137/13

[56] References Cited

U.S. PATENT DOCUMENTS

| | | | |
|---|---|---|---|
| 2,739,954 | 3/1956 | Fryling | 260/34.2 |
| 3,542,044 | 11/1970 | Hansen et al. | 252/8.55 R |
| 3,654,994 | 4/1972 | Slagel | 252/8.55 R |
| 3,682,187 | 8/1972 | Seymour et al. | 252/8.55 R |
| 3,733,294 | 5/1973 | Keown | 260/33.6 UA |
| 3,748,266 | 7/1973 | Malone et al. | 252/8.55 R |
| 3,758,406 | 9/1973 | Malone et al. | 252/8.55 R |
| 3,857,402 | 12/1974 | Schuh | 252/8.55 R |

FOREIGN PATENT DOCUMENTS

| | | | |
|---|---|---|---|
| 1,018,376 | 1/1966 | United Kingdom | 260/34.2 |

OTHER PUBLICATIONS

Sisley, J. P., *Encyclopedia of Surface-Active Agents* (Chemical Publishing Co., Inc., New York 1952), pp. 119–121.

Noble, R. J., *Latex in Industry* (Rubber Age, New York, 1953), pp. 355–357.

*Primary Examiner*—Benjamin R. Padgett
*Assistant Examiner*—Deborah L. Kyle
*Attorney, Agent, or Firm*—Thomas R. Weaver; John H. Tregoning

[57] ABSTRACT

This invention discloses a method for dissolving a hydrocarbon soluble polymeric internal phase of an aqueous external phase emulsion in a hydrocarbon liquid comprising mixing the emulsion and the hydrocarbon liquid together in the presence of a release agent to thereby cause the polymeric internal phase to dissolve in the hydrocarbon liquid.

28 Claims, No Drawings

METHOD FOR DISSOLVING POLYMERIC MATERIALS IN HYDROCARBON LIQUIDS

This invention relates to solutions of polymers dissolved in hydrocarbon liquids, and to a method for producing such solutions. This invention further, and more particularly, relates to the rapid dissolution of a polymer in a hydrocarbon liquid flowing in a conduit to thereby produce a significant reduction in the frictional resistance encountered by the hydrocarbon liquid as it flows through the conduit.

A recognized phenomenon in the art of transmitting a liquid through a conduit is the expenditure of energy caused by frictional resistance encountered by the liquid as it flows through the conduit. This frictional resistance causes the pressure of the liquid to decrease as it flows through the conduit and is therefore generally referred to as "frictional pressure loss." The expression, "frictional pressure loss," is more specifically utilized herein to mean the loss or decrease in pressure experienced by a liquid flowing through a conduit at a given velocity.

For a liquid of constant density and constant absolute viscosity flowing in a conduit of constant inside linear dimension, e.g. constant inside diameter, the frictional pressure loss increases as the mass velocity of the liquid flowing in the conduit increases. Furthermore, as the mass velocity of the liquid increases the type of flow changes from streamline flow, which is also called laminar flow, to turbulent flow. Thus, the frictional pressure loss experienced by a liquid in turbulent flow is greater than the frictional pressure loss experienced by a liquid in laminar flow.

The distinction between laminar flow and turbulent flow is well understood by those skilled in the art and discussion of the distinction is beyond the scope of this disclosure, thus recourse to standard references, such as Perry's *Chemical Engineers' Handbook* should be made for such discussion.

This invention deals with problems which can be associated with hydrocarbon liquids in turbulent flow; for example, a hydrocarbon liquid containing no friction reducing additive flowing in a conduit having a circular cross-section is considered to be in turbulent flow at flow rates which give a Reynolds number above about 2100 and preferably above about 3000. As is well understood by those skilled in the art, a Reynolds number, $N_{Re}$, is any of several dimensionless quantities, one of which is defined by the following relationship:

$$N_{Re} = (DV/\rho/\mu)$$

wherein:

$D$ is the inside diameter of a circular conduit, $V$ is the mean linear velocity of the liquid flowing through the conduit, $\rho$ is the density of the liquid flowing through the conduit, and $\mu$ is the absolute viscosity of the liquid flowing through the conduit.

Frictional pressure loss caused by the turbulent flow of hydrocarbon liquids in pipe is commonly encountered in many industrial operations. For example, hydrocarbon liquids, both in the pure state and in admixture with other hydrocarbon liquids and components including suspended solid materials, are commonly transferred over considerable distances by pipeline. In addition, in the hydraulic fracturing of subterranean well formations, hydrocarbon liquids, with and without propping agents suspended therein, are commonly pumped through long strings of tubing or pipe at high velocities in order to cause fracturing of the formation.

In order to compensate for the frictional pressure loss encountered in the tubulent flow of such hydrocarbon liquids considerable energy, generally in the form of pumping horsepower, must be expended. Accordingly, a reduction in frictional pressure loss could permit lower surface operating pressures, reduced horsepower requirements and greater bottom hole pressures in fracturing operations, and increased flow rates and reduced horsepower requirements in pipeline operations. Thus, reduction of the frictional pressure loss in the flow of hydrocarbon liquids can produce an advantageous reduction in horsepower requirements, or alternatively, an increased flow rate of the hydrocarbon liquids under the same pumping conditions.

Heretofore, various methods and additives for reducing the frictional pressure loss encountered in the flow of hydrocarbon liquids have been developed. For example, U.S. Pat. No. 3,654,994, U.S. Pat. No. 3,748,266 and U.S. Pat. No. 3,758,406 disclose the dissolution of a polymeric material (or materials) in a hydrocarbon liquid to achieve a substantial reduction in the frictional pressure loss normally suffered by the hydrocarbon liquid when it is flowed through a conduit under turbulent conditions. Accordingly, such a polymeric material is referred to generally as a "friction reducing additive" and such designation is utilized herein. A difficulty involved in the art resides in obtaining the rapid dissolution of the friction reducing additive in the hydrocarbon liquid. The dissolution has required a great deal of time and has therefore featured the formation of a concentrate solution of polymer in hydrocarbon, as one step, followed, as another step, by the addition of the concentrate to the hydrocarbon liquid flowing, or to be flowed, through a conduit.

The above referred to patents also disclose the use of a polymer latex, i.e. a polymer in water emulsion, to form the concentrate of polymer dissolved in a first hydrocarbon liquid followed by addition of the concentrate to a second hydrocarbon liquid flowing in a conduit. The concentrate rapidly dissolves in the second hydrocarbon liquid to achieve substantial reduction in frictional pressure loss. Since many polymers, such as those disclosed in the above patents, can be produced by polymerization processes conducted in aqueous media, the above patents provide methods for use of the polymer latex product of the polymerization to thereby avoid the need for recovering the polymer from the emulsion prior to formation of the concentrate. Use of the latex, however, to dissolve the friction reducing additive directly in the flowing hydrocarbon liquid has not been enabled by the prior art. The length of time required to release the polymer from the emulsion to enable the polymer to contact the hydrocarbon liquid to produce a polymer in hydrocarbon liquid solution has required retention of the concentrate forming step followed by the step of mixing the concentrate with the hydrocarbon liquid.

By this invention there is, accordingly, provided a method for producing a solution of a polymer dissolved in a hydrocarbon liquid. The method of the invention comprises mixing an aqueous emulsion, having a polymeric material as the internal phase thereof, with a hydrocarbon liquid and a release agent which causes the polymeric material to separate from the emulsion to thereby place it in sufficiently close contact with the hydrocarbon liquid to dissolve therein and produce the solution.

The release agents utilized herein can be selected from any one of several classes of materials which, it has now been discovered, cause the aqueous emulsion to invert, i.e. release the internal polymer phase, within various time periods ranging from a few seconds to several minutes. Thus, in accordance with this invention, a polymer in hydrocarbon liquid solution can be prepared either quite rapidly, i.e. in less than about 10 seconds, or over a longer period of time, i.e. in up to about 9 minutes, by simply directly mixing together the emulsion, the hydrocarbon liquid and the release agent.

One particularly valuable advantage inherent in this invention resides in those situations requiring dissolution of a friction reducing additive in a hydrocarbon liquid flowing under turbulent conditions in a conduit of relatively minor length. A situation such as this is encountered in the hydraulic fracturing of subterranean well formations wherein a large volume of hydrocarbon liquid can pass entirely through the entire length of the connected piping in a very short period of time, for example, in the range of from about 15 seconds to about 10 minutes. In these situations use of one of the release agents of this invention which causes very rapid dissolution of a friction reducing additive in the hydrocarbon liquid can enable direct mixing of the polymer latex with the hydrocarbon liquid flowing in the conduit. This procedure completely dispenses with the heretofore described essential step of forming a concentrate in order to obtain the desired polymer in hydrocarbon liquid solution. Those release agents of this invention which, after being mixed with the hydrocarbon liquid fracturing fluid and polymer latex, can produce about 65 percent reduction in friction pressure loss within about 60 seconds, and preferably within about 30 seconds, are particularly useful in those hydraulic fracturing operations where intermediate formation of a concentrate is not desired.

Where friction reduction is desired using release agents of this invention which do not produce rapid dissolution, i.e. 1 minute to 9 minutes, batch mixing operations can be utilized prior to flowing of the hydrocarbon through a conduit; also in these situations, such as in the movement of a hydrocarbon liquid through a pipeline of great length, requiring a long period of time for the liquid to pass through the entire length of a conduit, direct mixing of the release agent, the polymer latex and hydrocarbon can proceed because the dissolution time compared to the total flow time is negligible and the effect on the total available reduction of friction pressure loss is therefore also negligible.

The polymeric materials useful herein are produced by the polymerization of compounds represented by the general formula

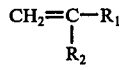

(1)

and mixtures thereof. In the above formula $R_1$ is selected from hydrogen and alkyl radicals having from 1 to about 20 carbon atoms and $R_2$ is selected from methyl radicals, phenyl radicals, alkyl phenyl radicals having from 7 to about 26 carbon atoms and carboxylate radicals having from 2 to about 19 carbon atoms.

In one preferred embodiment of the above general formula (1), $R_2$ is selected from the said phenyl and alkylphenyl radicals, thus general formula (1) is of the more specific form

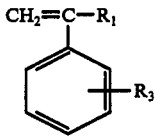

(2)

wherein $R_1$ is as previously defined and $R_3$ is selected from hydrogen and alkyl radicals having from 1 to about 20 carbon atoms. Compounds within the scope of formula (2) useful herein include alkyl styrenes, alpha alkyl styrenes and alpha alkyl alkylstyrenes. Of these three types of compounds alkyl styrenes are the most preferred for use herein.

Alkyl styrenes are compounds within the scope of formula (2) wherein $R_1$ is hydrogen and $R_3$ is selected from alkyl radicals having from 1 to about 20 and preferably from about 3 to about 10 carbon atoms. (In terms of general formula (1) $R_2$ is selected from alkylphenyl radicals having from 7 to about 26 and preferably from about 9 to about 16 carbon atoms.)

Examples of alkyl styrenes useful herein include but are not limited to
n-propyl styrene
i-propyl styrene
n-butyl styrene
i-butyl styrene
s-butyl styrene
t-butyl styrene
2-ethylbutyl styrene
n-hexyl styrene
2-ethylhexyl styrene
n-octyl styrene
n-decyl styrene
isodecyl styrene The most preferred alkyl styrene for use herein is t-butyl styrene.

Alpha alkyl styrenes are compounds within the scope of formula (2) wherein $R_1$ is selected from alkyl radicals having from 1 to about 20, preferably 4 to 10 and still more preferably 4 to 6 carbon atoms and $R_3$ is hydrogen. (In terms of general formula (1) $R_2$ is a phenyl radical.)

Examples of alpha alkyl styrenes useful herein include but are not limited to
alpha n-butyl styrene
alpha n-pentyl styrene
alpha n-hexyl styrene
alpha n-octyl styrene
alpha n-decyl styrene
alpha n-dodecyl styrene
alpha n-hexadecyl styrene The most preferred alpha alkyl styrene for use herein is alpha (n-hexyl) styrene.

Alpha alkyl alkylstyrenes are compounds within the scope of formula (2) wherein $R_1$ is selected from alkyl radicals having from 1 to about 20, preferably 1 to 10, and still more preferably 1 to 3 carbon atoms and $R_3$ is selected from alkyl radicals having from 1 to about 20, preferably 1 to 10, and still more preferably 4 to 6 carbon atoms. (In terms of general formula (1) $R_2$ is selected from alkyl phenyl radicals having from 7 to about 26, preferably 7 to 16, and still more preferably 10 to 12 carbon atoms.

Examples of alpha alkyl alkylstyrenes useful herein include but are not limited to
alpha methyl n-butylstyrene
alpha methyl t-butylstyrene
alpha methyl hexylstyrene
alpha methyl ethylhexylstyrene
alpha ethyl t-butylstyrene
alpha ethyl dodecylstyrene
alpha butyl t-butylstyrene
alpha butyl ethylhexylstyrene
alpha hexyl n-butylstyrene
alpha octyl sec-butylstyrene
alpha dodecyl methylstyrene The most preferred alpha alkyl alkylstyrene for use herein is alpha(methyl)t-butylstyrene.

In another preferred embodiment of the above general formula (1) $R_2$ is selected from the said carboxylate radicals, thus general formula (1) is of the more specific form

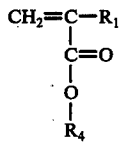

(3)

wherein $R_1$ is selected from hydrogen and alkyl radicals having from about 1 to about 20, preferably 1 to 10, and still more preferably 1 to 4 carbon atoms and $R_4$ is selected from alkyl radicals having from about 1 to about 18 and preferably 6 to 10, carbon atoms. Compounds within the scope of formula (3) useful herein include acrylates and alkacrylates. Of these two types of compounds alkacrylates are the most preferred for use herein.

Acrylates are compounds within the scope of formula (3) wherein $R_1$ is hydrogen and $R_4$ is selected from alkyl radicals having 1 to 18 and preferably 6 to 10 carbon atoms. (In terms of general formula (1) $R_2$ is a carboxyate radical having 2 to 19, preferably 7 to 11 carbon atoms.)

Examples of acrylates useful herein include but are not limited to
2-ethylhexyl acrylate
isobutyl acrylate
2-ethylbutyl acrylate
n-hexyl acrylate
lauryl acrylate
n-octyl acrylate
n-butyl acrylate
n-octyldecyl acrylate The most preferred acrylate for use herein is ethylhexylacrylate.

Alkacrylates are compounds within the scope of formula (3) wherein $R_1$ is preferably selected from alkyl radicals having 1 to 10 and more preferably 1 to 4 carbon atoms and $R_4$ is selected from alkyl radicals having 1 to 18 and preferably 6 to 10 carbon atoms. (In terms of general formula (1) $R_2$ is a carboxyate radical having 2 to 19, preferably 7 to 11 carbon atoms.)

Examples of alkacrylates useful herein include but are not limited to
isodecyl methacrylate
lauryl methacrylate
isobutyl methacrylate
cyclohexyl methacrylate
2-ethylbutyl methacrylate
n-hexyl methacrylate
iso octydecyl methacrylate
n-butyl ethacrylate
iso-butyl ethacrylate
hexyl ethacrylate
octyl ethacrylate
ethylhexyl ethacrylate
decyl ethacrylate
iso-butyl butacrylate
hexyl butacrylate
octyl butacrylate
ethylhexyl butacrylate The most preferred alkacrylate for use herein is isodecylmethacrylate.

In still another preferred embodiment of general formula (1), $R_1$ and $R_2$ are each methyl radicals, thus general formula (1) is of the more specific form

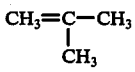

which is the formula for isobutylene.

The degree of polymerization of the polymeric material of the present invention must be such that the polymer exhibits viscoelastic properties and yet is soluble in the hydrocarbon liquid at the required concentration. This requires a relatively high molecular weight, for example, a molecular weight of from about 500,000 to about 1,000,000 or greater. The degree of polymerization is expressed herein in terms of intrinsic viscosity, i.e., an intrinsic viscosity in a good solvent of at least about 2 deciliter per gram (dl./g.) at 25° C. is required. By a good solvent is meant one which actually solvates the molecule, that is, the polymer and solvent are in greatest contact with the polymer parts contacting the solvent and not the polymer. Toluene and butyl acetate have been found to be good solvents for the polymers herein described. The determination of the intrinsic viscosity and the selection of suitable solvents, however, is readily within the ability of those skilled in the art, and accordingly a further description is not given herein.

The polymeric materials of the present invention are preferably polymerized to the degree that the intrinsic viscosity at 25° C. in a good solvent is from about 2 to about 10 dl./g. The upper limit, however, may vary significantly depending upon the particular polymer since the upper limit is controlled primarily by the solubility of the polymer in the hydrocarbon liquid.

The polymeric materials of this invention have been found to exhibit excellent shear stability, that is, the polymers are relatively insensitive to the effects of shear produced by the turbulent flow.

The polymeric material of the present invention can be prepared by solution polymerization and emulsion polymerization but are preferably prepared by emulsion polymerization techniques. Standard recipes for emulsion polymerization include four principal ingredients, namely, the monomer (or monomers) to be polymerized, water or mixtures of water and alcohol (the continuous phase), an emulsifier, and an initiator. In addition, certain reducing agents such as sodium bisulfite may be used to increase the rate of initiator dissociation and to reduce the inhibition period. Emulsifiers can be cationic, nonionic, anionic, amphoteric or combinations, examples of which include sodium laurylsulfate, potassium laurate, dioctyl sodium sulfosuccinate and potassium stearate. Suitable initiators include potassium persulfate, ammonium persulfate, cumyl hydroperoxide, t-butylperoxide, benzoyl peroxide and other water soluble organic peroxides and hydroperoxides. Other agents can also be used and in place of sodium bisulfite, water soluble salts of iron (II), copper (I), chromium (II), cobalt (II), vanadium (II), and titanium (III) can be used.

As an example of the preparation of the polymers, the laboratory procedure for the emulsion polymerization of monomers such as tertiary butyl styrene and isodecylmethacrylate is as follows:

A round bottom flask fitted with a suitable stirrer, a gas inlet, and a Liebig condenser with a gas outlet, is flushed with nitrogen or argon to remove atmospheric oxygen. The flask is then charged with the following ingredients in the following order: (1) emulsifier, initiator and reducing agent; (2) continuous phase; and (3) the monomer. The reaction vessel is subjected to a constant temperature, usually 50° to 60° C. Throughout the course of the reaction, the system is continuously flushed with an inert gas such as nitrogen or argon. The reaction runs for a period of from three to six hours at which time the polymer can be recovered from the latex by well known techniques or the latex can be used in accordance with this invention.

The aqueous emulsion — also referred to herein as the latex or polymer latex — can also include a glycol in the water external phase. The glycol provides a smooth texture and lowers the freezing point of the latex. Useful glycols include, but are not limited to, ethylene glycol, propylene glycol and diethylene glycol with ethylene glycol being preferred.

The emulsion can be prepared by polymerizing the monomer or monomers as above described and then adding the glycol or the emulsion can be prepared in a co-solvent system utilizing the glycol as one of the solvents.

The emulsion, in accordance with this invention, when mixed directly with a hydrocarbon liquid and the release agent of this invention, is comprised of an aqueous external phase present in the range of from about 50 to about 90, preferably from about 55 to about 70% , by weight of the emulsion, the hydrocarbon soluble polymer internal phase present in the range of from about 10 to about 50, preferably from about 30 to about 40% by weight of emulsion, and an emulsifier present in the range of from about 0.1 to about 5% by weight of emulsion. The aqueous external phase is comprised of a glycol present in the range of from about 0 to 75, preferably from about 30 to about 60% by weight of the external phase and water present in the range of from about 100 to 25, preferably from about 70 to about 40% by weight of the external phase.

The release agent of this invention is selected from chemical compounds which interact with the external phase of the polymer emulsion: to absorb the water; or to change the ionic balance of the emulsion; or to raise or lower the pH of the external phase; or to chemically react with the water in the external phase to thereby result in the inversion of the emulsion. Ideally those compounds best suited for use herein are those exhibiting more than one of the above recited characteristics. Furthermore, a relationship between release agent particle size and rate of emulsion inversion has been observed. Thus, a given release agent having a small particle size produces more rapid inversion of the emulsion than does the same release agent having a larger particle size. Release agents useful herein are those within the scope of the following general classes: anhydrous hygroscopic inorganic chemicals, hygroscopic organic polymers, concentrated aqueous solutions of inorganic salts, chemicals which react rapidly and/or violently with water, strongly acidic solutions and strongly basic solutions.

Anhydrous hygroscopic inorganic chemicals are preferred release agents for use herein when very rapid formation of a polymer in hydrocarbon liquid solution is required such as in hydraulic fracturing operations. The preference is based upon field experience, ease of handling, economics and low corrosivity. The preferred anhydrous hygroscopic inorganic chemicals include alkali metal and alkaline earth metal carbonates, bicarbonates, acetates and sulfates. These preferred chemicals can produce about 65 percent reduction in friction pressure loss in accordance with this invention in about 60 seconds or less. Other useful compounds within this group include alkali metal and alkaline earth metal and other metal halides, oxides, sulfides, nitrates, borates and the like.

Some specific examples of anhydrous hygroscopic inorganic chemicals useful herein include but are not limited to sodium bicarbonate, sodium acetate, sodium sulfate, magnesium sulfate, potassium bicarbonate, sodium carbonate, calcium sulfate, potassium carbonate, calcium chloride, sodium chloride, activated charcoal, aluminum trioxide and potassium carbonate. The most preferred chemical of this group is sodium bicarbonate.

Based upon factors generally associated with handling and field use in hydraulic fracturing operations, the release agents preferred are in the following descending order of preference: (1) anhydrous hygroscopic inorganic chemicals, (2) hygroscopic organic polymers, (3) concentrated aqueous solutions of inorganic salts, (4) strongly basic solutions, (5) strongly acidic solutions and (6) chemicals which react rapidly and/or violently with water.

Examples of anhydrous hygroscopic inorganic chemicals useful herein are discussed above.

The preferred hygroscopic organic polymers include water soluble polysaccharides such as naturally occurring gums, gum derivatives, water soluble cellulose derivatives, water soluble starches; water soluble polyacrylamides and water soluble derivatives thereof; water soluble polyacrylic acids; and vinyl ether maleic anhydride copolymers.

Examples of hygroscopic organic polymers useful herein include but are not limited to karaya gum, polyacrylamide, hydroxyethyl cellulose, carboxymethylcellulose, guar gum, starch and polyacrylic acid.

The preferred inorganic salts in concentrated aqueous solution include the alkali metal and alkaline earth metal halides such as calcium chloride and potassium chloride. The concentration of the salt is in the range of from about 0.25 to about 0.5 pounds of salt per pound of water.

The strongly basic solutions useful as release agents herein include the alkali metal hydroxides having a pH of at least about 10. Sodium hydroxide solution is an example of a release agent useful herein.

The strongly acidic solutions useful as release agents herein include the mineral acids, such as hydrochloric acid, having a pH of no greater than about 2.

Chemicals which react rapidly and/or violently with water which are useful herein as release agents include anhydrous organic and inorganic compounds.

The amount of release agent utilized to cause the release of the polymeric material from the emulsion is expressed in terms of the quality of release agent added to the hydrocarbon liquid. Thus, the preferred amount of release agent is in the range of from about 0.014 to about 7, more preferably 0.075 to about 1.5, still more preferably 0.15 to about 0.3, pounds of release agent per 100 pounds of hydrocarbon liquid. There is actually no known maximum quantity of release agent (expressed as pounds of release agent per pound of hydrocarbon liquid) required to cause the inversion of the emulsion. As a general rule, however, the greater the quantity of release agent utilized the more rapid will be the inversion.

The term "hydrocarbon liquid," as used herein, refers to those hydrocarbon compounds and mixtures thereof, with or without solids suspended therein and containing other conventional additives, which are in the liquid state at atmospheric conditions; and which have a viscosity such that they are pumpable; and which have sufficient solvency for the polymers of the present invention to dissolve desired quantities thereof. Such hydrocarbon liquids include petroleum products such as crude oil, gasoline, kerosene and fuel oil as well as straight and branched chain paraffin hydrocarbons, cyclo-paraffin hydrocarbons, monoolefin hydrocarbons, di-olefin hydrocarbons, alkene hydrocarbons and aromatic hydrocarbons such as benzene, toluene and xylene.

The amount of polymeric material to be dissolved in the hydrocarbon liquid in accordance with this invention can vary over a very wide range, for example, up to about 20 pounds of polymeric material to each 100 pounds of hydrocarbon liquid. However, where friction reduction is the object of the user then the quantity of polymeric material must not be in such great quantity as to substantially change the viscosity of the hydrocarbon liquid.

A remarkably low concentration of the polymeric material of the present invention produces superior reduction in the frictional pressure loss of hydrocarbon liquids in turbulent flow, for example, a concentration of from about 0.002 to 1.5 pounds of polymer per 100 pounds of hydrocarbon liquid produces superior reduction in frictional pressure loss. However, the concentration of the polymeric material is preferably maintained in the range of from about 0.024 to about 0.25 pounds per 100 pounds of hydrocarbon liquid with a concentration of from about 0.05 to about 0.1 pounds of polymer per 100 pounds of hydrocarbon liquid being most preferred.

Below a polymer concentration in a hydrocarbon liquid of about 0.002 pound per 100 pounds of liquid, insufficient polymeric material is present to effectively bring about a reduction in friction pressure loss. The optimum quantity of polymeric material required will vary somewhat depending upon the molecular weight of the polymer used and the type of hydrocarbon liquid involved. In hydraulic fracturing operations, concentrations of the polymer of from about 0.05 to about 0.1 pounds of polymer per 100 pounds of hydrocarbon liquid have been found to produce especially satisfactory reduction of friction pressure loss. However, at concentrations of the polymeric material above about 1.5 pounds per 100 pounds of hydrocarbon liquid the viscosity of the treated liquid increases to the extent that it is detrimental to reduction of friction pressure loss.

The release agent, emulsion and hydrocarbon liquid can be combined in any manner convenient to the user. The materials can be mixed together in a batch system or the materials can be combined directly in a conduit containing the flowing hydrocarbon liquid. In one embodiment the emulsion and hydrocarbon liquid can be mixed together to form a mixture and thereafter the mixture can be contacted with the release agent. In another embodiment the release agent and the hydrocarbon liquid can be mixed together to form a mixture and thereafter the mixture can be contacted with the emulsion. In still another embodiment, the release agent and the emulsion can be mixed simultaneously with the hydrocarbon liquid.

The release agent and the emulsion upon contact begin the process of releasing the polymer from the emulsion. Thus, the immediate presence of the hydrocarbon liquid is desirable in order to achieve rapid dissolution of the polymer. For most satisfactory results, and in order to avoid coagulation of the polymer, it is desirable that the release agent and the emulsion not be mixed together in the absence of the hydrocarbon liquid.

Preferred systems utilizing the method of this invention, particularly in hydraulic fracturing operations, comprise as the hydrocarbon liquid liquid aliphatic hydrocarbons such as hexane, kerosene and No. 2 Diesel oil; as the polymeric material polyisodecyl methacrylate, polytertiarybutylstyrene, polyethylhexylmethacrylate; and, as the release agent, acetyl chloride, sodium hydroxide and sodium bicarbonate. In such preferred systems, the quantity of polymer utilized is preferably in the range of from about 0.05 to 0.1 pounds per 100 pounds of hydrocarbon liquid and the quantity of release agent utilized is in the range of from about 0.15 to 0.3 pounds per 100 pounds of hydrocarbon liquid.

EXAMPLES

In certain of the examples which follow, friction reduction properties and the ability of a given release agent to invert the emulsion and release the polymer is determined by intermixing the polymer emulsion and release agent with kerosene and pumping the liquid mixture from a container through a six-foot section of 3/8 inch pipe and back through the container. The pressure drop in the section of pipe is continuously measured and recorded on an X-Y plotter (a conventional device which records percent reduction of friction pressure loss in the Y axis and time on the X axis). The percent of reduction in friction pressure loss is measured both initially and after a period of time. A zero reading, established with only kerosene flowing through the pipe, on the X-Y plotter indicates no reduction in friction, and a 100 reading, established with no fluid flow, indicates no friction at all. Thus, the higher the reading on the Y axis of the X-Y plotter, the more effective is the polymeric material for reducing friction pressure loss, and the time measured on the X axis indicates the speed with which a measured reduction in friction pressure loss is attained.

EXAMPLE 1

A water-ethylene glycol external emulsion of polyisodecyl methacrylate (PIDMA) is used as the reference polymer emulsion to evaluate release agents which will cause inversion of the emulsion and dissolution of the polymer in the hydrocarbon liquid which is kerosene.

The emulsion consists of 29.6% water by weight of emulsion, 29.9% ethylene glycol by weight of emulsion, 37.35% PIDMA by weight of emulsion, 3.13% sodium lauryl sulfate by weight of emulsion, 0.01% sodium ethylene diamine tetraacetic acid (EDTA) by weight of emulsion, and is polymerized with 0.01% potassium persulfate by weight of emulsion.

The release agents utilized are anhydrous hygroscopic inorganic chemicals, hygroscopic organic polymers, concentrated aqueous solutions of inorganic salts, chemicals which react rapidly and/or violently with water, solutions having a high pH and solutions having a low pH.

The release agent, emulsion and kerosene are simultaneously combined and analyzed for reduction in friction pressure loss in accordance with the procedure described above relating to the X-Y plotter.

The ratio of emulsion to kerosene utilized in all tests is 0.1 parts by volume of emulsion per 100 parts by volume of kerosene.

The ratio of release agent to kerosene utilized in all tests is 0.37 parts by weight of release agent per 100 parts by weight of kerosene unless otherwise specifically noted.

The temperature under which all the tests are conducted varies between 72° F and 81° F.

The results of the tests are reported in Tables 1*a* through 1*f*, inclusive, below. In each of Tables 1*a* — 1*f* the column headed "Time for 65% F.R. — seconds" is the number of seconds elapsed between the time of simultaneous addition of the emulsion and release agent to the kerosene and the time at which 65% reduction in friction pressure loss is obtained.

In each of Tables 1*a* — 1*f* the column headed "Response Time — seconds" is the number of seconds elapsed between the time of simultaneous addition of the emulsion and the release agent to the kerosene and the time at which maximum percent reduction in friction pressure loss is obtained.

In each of Tables 1*a* — 1*f* the column headed "Maximum % F.R." is the maximum percent reduction in friction pressure loss obtained with the release agent tested.

Table 1a

Friction Reduction Data for PIDMA Emulsion Using Anhydrous Hygroscopic Inorganic Chemicals

| Release Agent | Time for 65% F.R. (seconds) | Response Time (seconds) | Maximum % F.R. |
|---|---|---|---|
| $NaHCO_3$ | 10 | 24 | 76 |
| $CH_3CO_2Na$ | 13 | 30 | 73 |
| $Na_2SO_4$ | 15 | 42 | 76 |
| $MgSO_4$ | 15 | 42 | 74 |
| $KHCO_3$ | 18 | 54 | 76 |
| $Na_2CO_3$ | 18 | 60 | 76 |
| $CaSO_4$ | 21 | 48 | 80 |
| $K_2CO_3$ | 27 | 78 | 74 |
| $CaCl_2$ | 57 | 99 | 71 |
| NaCL | 90 | 204 | 70 |
| Activated Charcoal | 138 | 252 | 72 |
| $Al_2O_3$ | 150 | 180 | 66 |
| $K_2CO_3 \cdot 1.5\ H_2O$ | 198 | 450 | 70 |

Table 1b

Friction Reduction Data for PIDMA Emulsion Using Hygroscopic Organic Polymers

| Release Agent | Time for 65% F.R. (seconds) | Response Time (seconds) | Maximum % F.R. |
|---|---|---|---|
| Karaya Gum | 17 | 36 | 72 |
| Polyacrylamide | 20 | 66 | 77 |
| Hydroxyethyl Cellulose | 21 | 66 | 76 |

Table 1b-continued

Friction Reduction Data for PIDMA Emulsion Using Hygroscopic Organic Polymers

| Release Agent | Time for 65% F.R. (seconds) | Response Time (seconds) | Maximum % F.R. |
|---|---|---|---|
| Carboxymethyl Cellulose | 33 | 81 | 72 |
| Guar | 36 | 84 | 75 |
| Starch | 42 | 84 | 74 |
| Polyacrylic Acid | 42 | 78 | 70 |

Table 1c

Friction Reduction Data for PIDMA Emulsion Using Concentrated Aqueous Solutions of Inorganic Salts

| Release Agent | Time for 65% F.R. (seconds) | Response Time (seconds) | Maximum % F.R. |
|---|---|---|---|
| $CaCl_2$ (50 w/w, 0.3 v/v) * | 24 | 72 | 76 |
| $CaCl_2$ (25 w/w, 0.2 v/v) * | 30 | 78 | 76 |
| KCl (33 w/w, 0.6 v/v) * | 36 | 90 | 72 |
| $CaCl_2$ (25 w/w, 0.1 v/v) * | 36 | 96 | 76 |

* w/w means weight parts of chemical per 100 weight part of solution
v/v means volume parts of solution per 100 volume part of kerosene Table 1d Friction Reduction Data for PIDMA Emulsion Using Chemicals Which React Rapidly And/Or Violently With Water

| Release Agent | Time For 65% F.R. (seconds) | Response Time (seconds) | Maximum % F.R. |
|---|---|---|---|
| Acetyl Chloride (0.3 v/v) * | 9 | 21 | 78 |
| CaO | 32 | 84 | 72 |
| $AlCl_3$ | 33 | 42 | 67 |
| Acetic Anhydride (0.3 v/v) * | 72 | 150 | 70 |
| Phthalyl Dichloride (0.3 v/v) * | 78 | 150 | 70 |
| Benzoyl Trichloride (0.3 v/v) * | 360 | 492 | 68 |
| 2,4 Toluene Diisocyanate (0.3 v/v) * | 390 | 474 | 68 |

* v/v means volume parts of chemical per 100 volume parts of kerosene

Table 1e

Friction Reduction Data for PIDMA Emulsion Using Aqueous Solutions Having a High pH

| Release Agent | Time For 65% F.R. (seconds) | Response Time (seconds) | Maximum % F.R. |
|---|---|---|---|
| NaOH (50 w/w) (0.3 v/v) * | 18 | 45 | 80 |

*w/w means weight parts of chemical per 100 weight part of solution
v/v means volume parts of solution per 100 volume part of kerosene Table 1f Friction Reduction Data for PIDMA Emulsion Using Aqueous Solutions Having a Low pH

| Release Agent | Time For 65% F.R. (seconds) | Response Time (seconds) | Maximum % F.R. |
|---|---|---|---|
| HCl (15 w/w) (0.3 v/v) * | 18 | 42 | 78 |

* w/w means weight parts of chemical per 100 weight part of solution
v/v means volume parts of solution per 100 volume part of kerosene

EXAMPLE 2

A PIDMA emulsion, as described in Example 1, above (0.105 ml) and acetyl chloride (1 ml) are intermixed in 175 ml. of kerosene while agitating the fluid with a magnetic stirrer. The emulsion inverts immediately and the polymer dissolves indicating that these two components can be used to reduce the friction of a hydrocarbon liquid. When this test is performed in the previously described friction reduction test equipment using kerosene, PIDMA emulsion (0.1 parts by volume emulsion per 100 parts by volume kerosene), and acetyl chloride (0.3 parts by volume acetyl chloride per 100 parts by volume kerosene) a reduction in frictional pressure loss of 78% is achieved.

EXAMPLE 3

A subterranean hydrocarbon producing formation is hydraulically fractured using a 33° API gravity crude oil. A polymer in water emulsion, comprised of 38% polyisodecylmethacrylate by weight of emulsion, is added directly to the crude oil at the rate of 1.5 gallons emulsion per 1,000 gallons of oil (0.0697 pounds active polymer per 100 pounds of oil). In addition, 7 pounds of sodium bicarbonate per 1,000 gallons of oil (0.0977 pounds sodium bicarbonate per 100 pounds of oil), is added directly to the oil to invert the emulsion. A 47% reduction in friction pressure loss is obtained as compared to the base crude oil having no friction reducing additive and the hydraulic fracturing job is successful.

EXAMPLE 4

The PIDMA emulsion of Example 1 is tested with several release agents. The results of the tests are provided in Table 2, below.

The PIDMA emulsion is added to the base fluid, kerosene, in amounts expressed as gallons of emulsion per 1,000 gallons of base fluid. To convert the amount to pounds of polymer per 100 pounds of kerosene multiply the amount shown in Table 2 under the column headed "Emulsion" by the factor 0.0494.

The release agent is added to the base fluid, kerosene, in amounts expressed as pounds release agent per 1,000 gallons of base fluid. To convert the amount to pounds of release agent per 100 pounds of kerosene, multiply the amount shown in Table 2 under the column headed "Release Agent" by the factor 0.0148.

Table 2

| | Temperature - 78° F Base Fluid - Kerosene Concentrations | | | |
|---|---|---|---|---|
| Test No. | Emulsion (gal./1000) | Release Agent (lb./1000) | Response Time * | Maximum Percent F.R. |
| 1 | 1.0 | 25# $NaHCO_3$ | 48 sec. | 76 |
| 2 | 1.0 | 15# $NaHCO_3$ | 48 sec. | 76 |
| 3 | 1.0 | 10# $NaHCO_3$ | 51 sec. | 76 |
| 4 | 1.0 | 5# $NaHCO_3$ | 63 sec. | 76 |
| 5 | 1.0 | 2.5# $NaHCO_3$ | 120 sec. | 75 |
| 6 | 1.5 | 5# $NaHCO_3$ | 66 sec. | 76 |
| 7 | 1.0 | 50# A | 228 sec. | 75 |
| 8 | 1.0 | 50# B | 222 sec. | 46 |
| 9 | 1.0 | 50# B<br>5# $NaHCO_3$ | 42 sec. | 67 |
| 10 | 1.0 | 25# C | 165 sec. | 70 |
| 11 | 1.0 | 15# $NaHCO_3$<br>25# A | 39 sec. | 72 |
| 12 | 1.0 | 5# $NaHCO_3$<br>125# A | 45 sec. | 76 |

* Response time is the time elapsed between the simultaneous addition of all chemicals to the base fluid and the point at which maximum friction reduction, F.R., is achieved.

In Table 2, Component A is a commercially available fluid loss additive which is slowly soluble in oil and comprised of sulfonated aromatic chemicals. Component B is a commercially available silica flour. Component C is a commercially available material comprised of clays, silicates and guar gum.

This invention is not limited to the above described specific embodiments thereof; it must be understood therefore that the detail involved in the descriptions of the specific embodiments is presented for the purpose of illustration only, and that reasonable variations and modifications, which will be apparent to those skilled in the art, can be made in this invention without departing from the spirit or scope thereof.

Having thus described the invention, that which is claimed is:

1. A method for producing a solution of a polymer dissolved in a hydrocarbon liquid consisting essentially of:

mixing an aqueous emulsion, having said polymer as the internal phase thereof, with a release agent in the immediate presence of said hydrocarbon liquid to thereby produce said solution within a time of about one minute wherein within said time said solution exhibits at least 65 percent less frictional resistance in turbulent flow than does said hydrocarbon liquid;

wherein said hydrocarbon liquid is selected from the group consisting of straight and branched chain paraffin hydrocarbons, cyclo-paraffin hydrocarbons, mono-olefin hydrocarbons, di-olefin hydrocarbons, alkene hydrocarbons, aromatic hydrocarbons, crude oil and mixtures thereof, said hydrocarbon liquid being in the liquid state at atmospheric conditions;

wherein said polymer is produced by the polymerization of compounds represented by the general formula $$CH_2{=}\underset{\underset{R_2}{|}}{C}{-}R_1$$

and mixtures thereof, wherein $R_1$ is selected from hydrogen and alkyl radicals having 1 to 20 carbon atoms and $R_2$ is selected from methyl radicals, phenyl radicals, alkyl phenyl radicals having 7 to 26 carbon atoms and carboxylate radicals having 2 to 19 carbon atoms; and further wherein said release agent is selected from the group consisting of anhydrous hygroscopic chemicals, selected from the group consisting of alkali metal and alkaline earth metal carbonates, bicarbonates, acetates halides, and sulfates; hygroscopic organic polymers, selected from the group consisting of water soluble polysaccharides, water soluble polyacrylamides, water soluble polyacrylic acids and vinyl ether maleic anhydride copolymers; concentrated aqueous solutions or inorganic salts, selected from the group consisting of alkali metal and alkaline earth metal halides; chemicals which react with water, selected from the group consisting of acetyl chloride, acetic anhydride, phthalyl dichloride, calcium oxide and aluminum trichloride; strongly acidic solutions of mineral acids having a pH of no greater than about 2; and strongly basic solutions of alkali metal hydroxides having a pH of at least about 10.

2. The method of claim 1 wherein said $R_2$ is selected from said phenyl and said alkylphenyl radicals.

3. The method of claim 2 wherein said $R_1$ is hydrogen and said $R_2$ is selected from alkylphenyl radicals having 9 to 16 carbon atoms.

4. The method of claim 2 wherein said $R_1$ is selected from alkyl radicals having 4 to 10 carbon atoms and said $R_2$ is phenyl.

5. The method of claim 4 wherein said $R_1$ is selected from alkyl radicals having 4 to 6 carbon atoms.

6. The method of claim 2 wherein said $R_1$ is selected from alkyl radicals having 1 to 10 carbon atoms and said $R_2$ is selected from alkylphenyl radicals having 7 to 16 carbon atoms.

7. The method of claim 6 wherein said $R_1$ is selected from alkyl radicals having 1 to 3 carbon atoms and said $R_2$ is selected from alkyl phenyl radicals having 10 to 12 carbon atoms.

8. The method of claim 1 wherein said $R_2$ is a carboxylate radical having 2 to 19 carbon atoms and said $R_1$ is selected from hydrogen and alkyl radicals having 1 to 10 carbon atoms.

9. The method of claim 8 wherein said $R_2$ is a carboxylate radical having 7 to 11 carbon atoms and said $R_1$ is hydrogen.

10. The method of claim 8 wherein said $R_2$ is a carboxylate radical having 7 to 11 carbon atoms and said $R_1$ is an alkyl radical having 1 to 4 carbon atoms.

11. The method of claim 1 wherein said $R_1$ is a methyl radical and said $R_2$ is a methyl radical.

12. A method for decreasing the frictional resistance of a hydrocarbon liquid flowing in turbulence in a conduit consisting essentially of:

dissolving a polymer in said hydrocarbon liquid by mixing an aqueous emulsion, with a release agent in the immediate presence of said hydrocarbon liquid wherein said aqueous emulsion contains as the internal phase thereof a polymer which is soluble in said hydrocarbon liquid whereby said polymer dissolves in said hydrocarbon liquid to thereby reduce said frictional resistance of said hydrocarbon liquid flowing in said conduit at least about 65 percent within a time of about one minute;

wherein said hydrocarbon liquid is selected from the group consisting of straight and branched chain paraffin hydrocarbons, cyclo-paraffin hydrocarbons, mono-olefin hydrocarbons, di-olefin hydrocarbons, alkene hydrocarbons, aromatic hydrocarbons, crude oil and mixtures thereof, said hydrocarbon liquid being in the liquid state at atmospheric conditions;

wherein said polymer is produced by the polymerization of compounds represented by the general formula $$CH_2{=}\underset{\underset{R_2}{|}}{C}{-}R_1$$

and mixtures thereof, wherein $R_1$ is selected from hydrogen and alkyl radicals having 1 to 20 carbon atoms and $R_2$ is selected from methyl radicals, phenyl radicals, alkyl phenyl radicals having 7 to 26 carbon atoms and carboxylate radicals having 2 to 19 carbon atoms; and further wherein said release agent is selected from the group consisting of anhydrous hygroscopic chemicals, selected from the group consisting of alkali metal and alkaline earth metal carbonates, bicarbonates, acetates halides, and sulfates; hygroscopic organic polymers, selected from the group consisting of water soluble polysaccharides, water soluble polyacrylamides, water soluble polyacrylic acids and vinyl ether maleic anhydride copolymers; concentrated aqueous solutions of inorganic salts, selected from the group consisting of acetyl chloride, acetic anhydride, phthalyl dichloride, calcium oxide and aluminum trichloride; strongly acidic solutions of mineral acids having a pH of no greater than about 2; and strongly basic solutions of alkali metal hydroxides having a pH of at least about 10.

13. The method of claim 12 wherein said mixing is conducted simultaneously with the flowing of said hydrocarbon liquid into said conduit.

14. The method of claim 12 wherein said aqueous emulsion is comprised of an aqueous external phase present in the range of from about 50 to about 90 percent by weight of said emulsion and said polymer as the internal phase is present in the range of from about 10 to about 50 percent by weight of said emulsion; and further wherein said polymer is present in the range of from about 0.002 to about 1.5 pounds of said polymer per 100 pounds of said hydrocarbon liquid and said release agent is present in the range of from about 0.014 to about 7 pounds of said release agent per 100 pounds of said hydrocarbon liquid.

15. The method of claim 1 wherein said release agent is an anhydrous hygroscopic chemical selected from alkali metal and alkaline earth metal carbonates, bicarbonates, acetates, and sulfates.

16. The method of claim 15 wherein $R_1$ is selected from hydrogen and alkyl radicals having 1 to 10 carbon atoms and $R_2$ is a carboxylate radical having 2 to 19 carbon atoms.

17. The method of claim 1 wherein said polymer is polyisodecylmethacrylate and said release agent is sodium bicarbonate.

18. The method of claim 14 wherein said release agent is selected from acetyl chloride, sodium hydroxide and sodium bicarbonate.

19. The method of claim 18 wherein said polymer is selected from polyisodecyl methacrylate, polytertiarybutylstyrene and polyethylhexylmethacrylate.

20. The method of claim 19 wherein said hydrocarbon liquid is selected from liquid aliphatic hydrocarbons.

21. The method of claim 20 wherein said polymer is present in the range of from about 0.05 to about 0.1 pounds per 100 pounds of said hydrocarbon liquid and said release agent is present in the range of from about 0.15 to about 0.3 pounds per 100 pounds of said hydrocarbon liquid.

22. The method of claim 21 wherein said external phase of said emulsion is comprised of water present in the range of from about 70 to about 40% by weight of said emulsion and a glycol present in the range of from about 30 to about 60% by weight of said emulsion.

23. The method of claim 22 wherein said glycol is ethylene glycol present in the amount of about 50% by weight of said external phase and wherein said water is present in the amount of about 50% by weight of said external phase.

24. The method of claim 23 wherein said polymer is polyisodecyl methacrylate present in the amount of about 38% by weight of said emulsion.

25. The method of claim 1 wherein said release agent is selected from the group consisting of sodium bicarbonate, sodium acetate, sodium sulfate, magnesium sulfate, potassium bicarbonate, sodium carbonate, calcium sulfate, potassium carbonate, calcium chloride, sodium chloride, potassium carbonate, karaya gum, polyacrylamide, hydroxyethyl cellulose, carboxymethylcellulose, guar gum, starch, polyacrylic acid, potassium chloride, acetyl chloride, calcium oxide, aluminum chloride, acetic anhydride, phthalyl dichloride, sodium hydroxide and hydrochloric acid.

26. The method of claim 12 wherein said release agent is selected from the group consisting of sodium bicarbonate, sodium acetate, sodium sulfate, magnesium sulfate, potassium bicarbonate, sodium carbonate, calcium sulfate, potassium carbonate, calcium chloride, sodium chloride, potassium carbonate, karaya gum, polyacrylamide, hydroxyethyl cellulose, carboxymethylcellulose, guar gum, starch, polyacrylic acid, potassium chloride, acetyl chloride, calcium oxide, aluminum chloride, acetic anhydride, phthalyl dichloride, sodium hydroxide and hydrochloric acid.

27. The method of claim 25 wherein said polymer is produced by the polymerization of compounds selected from the group consisting of n-propyl styrene, i-propyl styrene, n-butyl styrene, i-butyl styrene, s-butyl styrene, t-butyl styrene, 2-ethylbutyl styrene, n-hexyl styrene, 2-ethylhexyl styrene, n-octyl styrene, n-decyl styrene, isodecyl styrene, alpha n-butyl styrene, alpha n-pentyl styrene, alpha n-hexyl styrene, alpha n-octyl styrene, alpha n-decyl styrene, alpha n-dodecyl styrene, alpha n-hexadecyl styrene, alpha methyl n-butylstyrene, alpha methyl t-butylstyrene, alpha methyl hexylstyrene, alpha methyl ethylhexylstyrene, alpha ethyl t-butylstyrene, alpha ethyl dodecylstyrene, alpha butyl t-butylstyrene, alpha butyl ethylhexylstyrene, alpha hexyl n-butylstyrene, alpha octyl sec-butylstyrene, alpha dodecyl methylstyrene, 2-ethylhexyl acrylate, isobutyl acrylate, 2-ethylbutyl acrylate, n-hexyl acrylate, lauryl acrylate, n-octyl acrylate, n-butyl acrylate, n-octyldecyl acrylate, isodecyl methacrylate, lauryl methacrylate, isobutyl methacrylate, cyclohexyl methacrylate, 2-ethylbutyl methacrylate, n-hexyl methacrylate, iso octydecyl methacrylate, n-butyl ethacrylate, iso-butyl ethacrylate, hexyl ethacrylate, octyl ethacrylate, ethylhexyl ethacrylate, decyl ethacrylate, iso-butyl butacrylate, hexy butacrylate, octyl butacrylate, ethylhexyl butacrylate, and isobutylene.

28. The method of claim 26 wherein said polymer is produced by the polymerization of compounds selected from the group consisting of n-propyl styrene, i-propyl styrene, n-butyl styrene, i-butyl styrene, s-butyl styrene, t-butyl styrene, 2-ethylbutyl styrene, n-hexyl styrene, 2-ethylhexyl styrene, n-octyl styrene, n-decyl styrene, isodecyl styrene, alpha n-butyl styrene, alpha n-pentyl styrene, alpha n-hexyl styrene, alpha n-octyl styrene, alpha n-decyl styrene, alpha n-dodecyl styrene, alpha n-hexadecyl styrene, alpha methyl n-butylstyrene, alpha methyl t-butylstyrene, alpha methyl hexylstyrene, alpha methyl ethylhexylstyrene, alpha ethyl t-butylstyrene, alpha ethyl dodecylstyrene, alpha butyl t-butylstyrene, alpha butyl ethylhexylstyrene, alpha hexyl n-butylstyrene, alpha octyl sec-butylstyrene, alpha dodecyl methylstyrene, 2-ethylhexyl acrylate, isobutyl acrylate, 2-ethylbutyl acrylate, n-hexyl acrylate, lauryl acrylate, n-octyl acrylate, n-butyl acrylate, n-octyldecyl acrylate, isodecyl methacrylate, lauryl methacrylate, isobutyl methacrylate, cyclohexyl methacrylate, 2-ethylbutyl methacrylate, n-hexyl methacrylate, iso octydecyl methacrylate, n-butyl ethacrylate, iso-butyl ethacrylate, hexyl ethacrylate, octyl ethacrylate, ethylhexyl ethacrylate, decyl ethacrylate, iso-butyl butacrylate, hexy butacrylate, octyl butacrylate, ethylhexyl butacrylate, and isobutylene.

* * * * *

UNITED STATES PATENT AND TRADEMARK OFFICE

CERTIFICATE OF CORRECTION

PATENT NO. : 4,068,676

DATED : January 17, 1978

INVENTOR(S) : DONALD J. THORN and JOHN W. BURNHAM

It is certified that error appears in the above-identified patent and that said Letters Patent are hereby corrected as shown below:

Column 1, at line 51, delete the formula [$N_{Re}=(DV/\rho/\mu)$] and insert therefor the following formula:

$$N_{Re} = \frac{DV\rho}{\mu}$$

Column 9, at line 3, delete [quality] and insert therefor --quantity--.

Column 14, Claim 1, at line 42, between the words "acetates" and "halides," insert a comma --,--.

Column 14, in Claim 1, at line 47, delete [or] and insert therefor --of--.

Column 15, Claim 12, at line 59, between "acetates" and "halides" insert a comma --,--.

Column 16, in Claim 15, at line 21, between the words "acetates," and "and" insert --halides--.

Signed and Sealed this

Thirtieth Day of May 1978

[SEAL]

Attest:

RUTH C. MASON
Attesting Officer

LUTRELLE F. PARKER
Acting Commissioner of Patents and Trademarks